US010618335B2

(12) United States Patent
Zhou et al.

(10) Patent No.: US 10,618,335 B2
(45) Date of Patent: Apr. 14, 2020

(54) EMBOSSED PRINT MEDIA

(71) Applicant: Hewlett-Packard Development Company, L.P., Fort Collins, CO (US)

(72) Inventors: Xiaoqi Zhou, San Diego, CA (US); Xulong Fu, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 43 days.

(21) Appl. No.: 15/765,553

(22) PCT Filed: Dec. 15, 2015

(86) PCT No.: PCT/US2015/065728
§ 371 (c)(1),
(2) Date: Apr. 3, 2018

(87) PCT Pub. No.: WO2017/105404
PCT Pub. Date: Jun. 22, 2017

(65) Prior Publication Data

US 2018/0319192 A1 Nov. 8, 2018

(51) Int. Cl.
*B41M 5/50* (2006.01)
*B41M 5/52* (2006.01)

(52) U.S. Cl.
CPC ..... *B41M 5/502* (2013.01); *B41M 5/52* (2013.01); *B41M 5/5218* (2013.01); (Continued)

(58) Field of Classification Search
CPC ..... B41M 5/502; B41M 5/52; B41M 5/5281; B41M 5/5272; B41M 5/5218; B41M 5/5263
See application file for complete search history.

(56) References Cited

U.S. PATENT DOCUMENTS 4,489,188 A 12/1984 Jones et al.
5,236,987 A 8/1993 Arendt
(Continued)

FOREIGN PATENT DOCUMENTS

CN 1662390 8/2005
EP 1089880 2/2004
(Continued)

OTHER PUBLICATIONS

Machine Translation of WO 2015/012833. (Year: 2015).*
(Continued)

*Primary Examiner* — Brian Handville
(74) *Attorney, Agent, or Firm* — Thorpe North & Western LLP

(57) ABSTRACT

The present disclosure is drawn to embossed print media. In some examples, an embossed print medium can include a media substrate, an embossed image-receiving layer formed on the media substrate, and an abrasion-resistant layer applied to the embossed image-receiving layer. The embossed image-receiving layer can include a first pigment filler and a polymer blend of a water-dispersible polymer and a water-soluble polymer at a weight ratio from 2:1 to 10:1. Further, the image-receiving layer can be embossed at an embossing depth from 5 μm to 150 μm. The abrasion-resistant layer can be applied to the image-receiving layer at a coating weight of from 2 gsm to 20 gsm. The abrasion-resistant layer can include a cross-linked polymer network and a second pigment filler.

20 Claims, 2 Drawing Sheets

(52) U.S. Cl.
CPC ..... *B41M 5/5272* (2013.01); *B41M 5/5281* (2013.01); *B41M 5/5263* (2013.01)

(56) References Cited

U.S. PATENT DOCUMENTS

| | | | | |
|---|---|---|---|---|
| 6,409,333 | B1 | 6/2002 | Nishikawa | |
| 6,503,977 | B1 | 1/2003 | Branham et al. | |
| 6,688,741 | B2 | 2/2004 | Nishikawa | |
| 6,857,736 | B2 | 2/2005 | Onishi et al. | |
| 6,974,609 | B2 | 12/2005 | Engle et al. | |
| 7,696,262 | B2 | 4/2010 | Cagle et al. | |
| 2002/0127372 | A1 | 9/2002 | Waite et al. | |
| 2002/0192436 | A1* | 12/2002 | Voeght | B41C 1/148 428/32.34 |
| 2003/0103129 | A1* | 6/2003 | Tanaka | B41M 5/52 347/105 |
| 2006/0115628 | A1* | 6/2006 | Nair | B41M 5/52 428/195.1 |
| 2008/0176039 | A1 | 7/2008 | Chen et al. | |
| 2009/0202753 | A1* | 8/2009 | Teramae | B32B 27/08 428/32.2 |
| 2009/0238973 | A1* | 9/2009 | Wachi | B41M 5/0023 427/256 |
| 2011/0039043 | A1* | 2/2011 | Klemann | B41M 5/502 428/32.37 |
| 2011/0305851 | A1* | 12/2011 | Wang | B41M 5/52 428/32.31 |
| 2014/0240391 | A1* | 8/2014 | Goto | C09D 11/322 347/20 |
| 2015/0035896 | A1* | 2/2015 | Gotou | B41J 11/0015 347/20 |

FOREIGN PATENT DOCUMENTS

| | | |
|---|---|---|
| EP | 2050784 | 4/2009 |
| JP | 2001079974 | 3/2001 |
| JP | 2003041488 | 2/2003 |
| JP | 2005271521 | 10/2005 |
| JP | 2006271771 | 10/2006 |
| WO | 2004028821 | 4/2004 |
| WO | 2015012833 | 1/2015 |
| WO | 2015058972 | 4/2015 |
| WO | 2017048276 | 3/2017 |

OTHER PUBLICATIONS

Machine Translation of JP 2001-079974. (Year: 2001).*
International Search Report dated Sep. 12, 2016 for PCT/US2015/065728, Applicant Hewlett-Packard Development Company, L.P.

* cited by examiner

EMBOSSED PRINT MEDIA

BACKGROUND

Inkjet printing technology has been used in many fields of printing for many different applications, including from traditional home and office usage to high-speed, commercial, and industrial printing. This is, in part, because of its ability to produce economical, high quality, multi-colored prints. Various types of media have been used for inkjet imaging, including porous media, smooth media, offset media, coated media, etc. With any of these different types of media, different challenges are presented.

DETAILED DESCRIPTION

Figure 1:
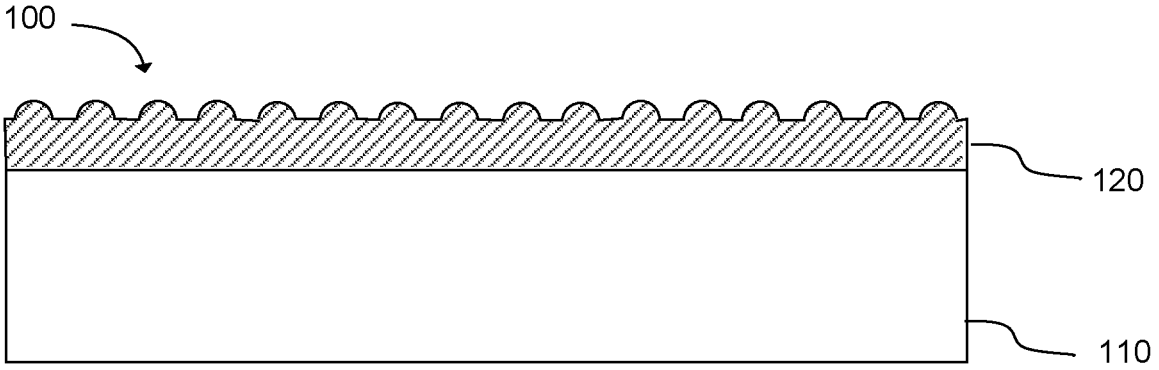
FIG. 1 is a cross-sectional view of an embossed print medium with an image-receiving layer, but without an abrasion-resistant layer, in accordance with examples of the present disclosure.

Various types of media have been used for inkjet imaging, including porous media, smooth media, offset media, coated media, etc. However, in accordance with examples of the present disclosure, textured media, such as embossed media, presents certain issues when it comes to image quality and other printing properties. Embossing is a process by which a texture is applied into a print medium during manufacturing. These embossed features can be aesthetically pleasing in some respects, but printing on an embossed surface can be challenging. For example, embossing can compromise the potential durability of an ink printed on the embossed print medium. "Durability" generally refers to the ability of a printed image on a print medium to withstand a strong mechanical force, such as scratching and rubbing (wet and/or dry). For example, for one industry standard known as "Standard Classification of Wall Covering by Use Characteristics" (ASTM F793), to achieve a Category II (or higher) decorative with at least medium serviceability, printed media is found to be acceptable that passes at least 300 cycles of an ASTM F793 scrubbability test. Often, textured surfaces of print media are compromised during scrubbability or scratch testing, which is problematic.

The present disclosure can relate to enhancing or improving print durability for embossed print media, and/or improving print image quality on embossed surfaces. Accordingly, the present disclosure is drawn to embossed print media. In some examples, an embossed print medium can include a media substrate, an embossed image-receiving layer formed on the media substrate, and an abrasion-resistant layer applied to the embossed image-receiving layer. More specifically, the embossed image-receiving layer can include a first pigment filler and a polymer blend of a water-dispersible polymer and a water-soluble polymer at a weight ratio from 2:1 to 10:1. Further, the image-receiving layer can be embossed at an embossing depth from 5 μm to 150 μm. The abrasion-resistant layer can be applied to the image-receiving layer at a coating weight of from 2 gsm to 20 gsm. The abrasion-resistant layer can include a cross-linked polymer network and a second pigment filler.

A method of preparing an embossed print medium is also disclosed and can include applying an image-receiving layer to a media substrate, embossing the image-receiving layer on a media substrate to form an embossed image-receiving layer, and applying an abrasion-resistant layer at a coating weight of from 2 gsm to 20 gsm to the embossed image-receiving layer. The embossing can be at a depth from 5 μm to 150 μm, and the abrasion-resistant layer can be applied at a coating weight of from 2 gsm to 20 gsm to the embossed image-receiving layer. In one example, the image-receiving layer can include a first pigment filler and a polymer blend of a water-dispersible polymer and a water-soluble polymer at a weight ratio from 2:1 to 10:1. The abrasion-resistant layer can include a cross-linked polymer network and a second pigment filler.

In another example, a printed article can include an embossed print medium with a printed feature applied to the embossed print medium described herein.

The cross-linked polymer network can include a polyurethane, an epoxy, or a combination thereof. In still another example, the abrasion-resistant layer can further include a wax. In a more specific example, the abrasion-resistant layer can include from 10 wt % to 80 wt % of the cross-liked polymer network, from 5 wt % to 40 wt % of the second pigment filler, wherein the second pigment filler has an average particle size from 0.1 μm to 5 μm, and from 3 wt % to 20 wt % of a polyethylene wax. In one example, the cross-linked polymer network can include a polyurethane and an epoxy at a weight ratio from 2:1 to 1:2.

Furthermore, the textured or embossed print medium can be created by a variety of embossing and un-embossing techniques. Such embossing and un-embossing techniques are the processes of creating either raised or recessed relief images and designs in paper and other materials. An embossed pattern is raised against the background, while an un-embossed pattern is sunken into the surface of the material. In some examples, the textured media is a media that has been embossed. Said embossed media is capable of retaining all of its inherent imaging and performance properties. The textured media can be obtained by embossing a pattern into a media via passing said media between rollers with a patterned surface.

A standard embossing machine typically includes two (or more) rollers: an embossing roller and a backing roller. The embossing roller can be laser or acid engraved with a specific pattern that is designed by a graphic designer. The backing roller can have a rubber cover or paper/wool type backing. The print media can pass through the nip between the embossing roller and backing roller. The nip is often pressurized with a hydraulic system. After the embossing process, the print media surface will mimic the design pattern of an embossing roller. The depth of the embossed texture is dependent on a variety of factors such as paper surface property, embossing pressure, machine speed, and engraving depth and pattern.

The technique for embossing a texture, pattern and/or design onto a media can involve molding the surface of a media by forcing it between a pressure nip formed by embossing rollers. The textured printable media can also be obtained by using embossing cylinders that may be mechanically or chemically etched with a specific pattern and/or design. The textured media can be created using an embossing roller under pressure. The media is altered during texturing by creating embossed depths ranging from about 5 μm to about 150 μm or from about 5 μm to about 90 μm. In one specific example, embossing can produce a peak-valley differential average of about 50 μm. The Parker Print Surface (PPS) roughness for embossed printable media can vary from about 5 μm to about 15 μm at 1600 psi pressure on the embossing roll. The load and depth of pattern increases the surface roughness. The Confocal microscope Zygo surface roughness can increase from 0.2310 Rq Rz (rmsmic) to 2.0850 Rq Rz (rmsmic). The static coefficient of friction does not change but the kinetic coefficient of friction slightly decreases as the surface area is reduced. In some examples, the surface roughness of the printable media is greater than 5 μm per PPS method.

Embossing can be used with a variety of suitable materials. For example, the supporting media substrate can be made of natural fiber and can include natural cellulose fiber from either a hardwood species alone, or a hardwood species and a softwood species mixed. In one example, a ratio of hardwood fiber to softwood fiber can be within a range of about 100:0 to about 50:50. The natural cellulose fibers may be processed into various pulps including, but not limited to, wood-free pulp, such as bleached or unbleached kraft chemical pulp and bleached or unbleached sulfite chemical pulp; wood-containing pulp, such as one or more of ground wood pulp, thermo-mechanical pulp, and chemo-thermo-mechanical pulp; pulp of non-wood natural fiber, such as one or more of bamboo fiber, bagasse fiber, recycled fiber, cotton fiber; and a combination of two or more pulps, or a mixture of two or more of pulps. The above fiber compositions of the supporting media substrate may include both synthetic fibers and natural fibers. An amount of synthetic polymeric fiber over the natural fiber may be within a range of about 10 wt % to about 80 wt % by weight of total fiber. In some examples, the amount of synthetic polymeric fiber by weight of total fiber in the media substrate is about 20 wt % to about 70 wt %, or about 30 wt % to about 60 wt %. In another example, the support substrate is a polymeric film.

In one specific example, with an understanding that these specific materials and weight values are expandable, the media substrate can be fabricated using 100 parts of a fiber mixture that includes about 22 parts of softwood bleached kraft pulp, 65 parts of hardwood bleached kraft pulp, and 13 parts recycled fibers. The mixture of pulps and fibers can be machine broken in water. Both softwood and hardwood kraft pulps can be refined separately using a double disc refiner and mixed with other fibers in the ratio mentioned above. About 20 wt % to about 25 wt % fines having an average length of less than 0.1 mm can be included in the substrate. A mixture of inorganic particles can be added into the fiber furnish to achieve about 13 wt % target ash content. The inorganic particles can include grounded calcium carbonate powder and TiO2 powder in a weight ratio of 10 parts to 1.5 parts. The substrate can be made using a commercial Fourdrinier paper machine. After the composite web is dried, the web can be brought to a surface size station with a rod metering size press machine. A surface size solution can be applied on the surface of the substrate web and dried.

To these or other media substrates that are capable of receiving and holding an embossed pattern, an image-receiving layer(s) can be applied. The function of the image-receiving layer(s) is to provide an acceptable surface so the ink can be deposited onto it and generate acceptable print quality. The image-receiving layer(s) can facilitate both image quality and image durability.

The image-receiving layer can be a single layer or multiple layers with the same or different coating compositions. The total coat weight of the image-receiving layer may fall within any suitable range. In one example, the dry coating weight can be from about 1 gram per square meter (gsm) to about 50 gsm. In another example, the dry coating weight can range from about 5 gsm to about 30 gsm. In another example, the dry coating weight can range from about 5 gsm to about 20 gsm. In another example, the dry coating weight can range from about 10 gsm to about 20 gsm. Application of the coating can be by any method known in the art, including Meyer rod applicator, knife coating applicator, curtain coating applicator, or the like. Once coated, the image-receiving composition dries to form the image-receiving layer. In some non-limiting examples, the thickness of the image-receiving layer can range from about 5 microns (μm) to about 40 μm.

Once the image-receiving layer is applied to the print medium, the surface of the print medium can be textured via an embossing process, as previously described. In one example, the print medium can be embossed at an embossing depth from 5 μm to 150 μm. In another example, the image-receiving layer can be embossed at an embossing depth from 5 μm to 120 μm. In another example, the image-receiving layer can be embossed at an embossing depth from 5 μm to 90 μm, at an embossing depth of 10 μm to 90 μm, or at an embossing depth of 25 μm to 90 μm.

In some examples, the image-receiving layer can include a polymeric binder. Any suitable polymeric binder can be used. In one example, the polymeric binder can be an aqueous based polymeric binder. Examples of suitable polymeric binders include polyvinyl alcohol, styrene-butadiene emulsion, acrylonitrile-butadiene latex, and combinations thereof. Moreover, in addition to the above binders, other aqueous binders can be added including starch (including oxidized starch, cationized starch, esterified starch, enzymatically denatured starch, and so on), gelatin, casein, soybean protein, cellulose derivatives including carboxymethyl cellulose, hydroxyethyl cellulose and the like; acrylic emulsion, vinyl acetate emulsion, vinylidene chloride emulsion, polyester emulsion, and polyvinylpyrrolidone. Other examples of suitable polymeric binders include aqueous based binders such as polyvinyl alcohol (examples of which include Kuraray Poval®235, Mowiol®6-98, Mowiol®40-88, and Mowiol®20-98 available from Kuraray America, Inc.), styrene-butadiene emulsions, acrylonitrile-butadiene latex, and combinations thereof. In one example, the amount of the polymeric binder present in the image-receiving layer can be from about 5 to about 40 parts per 100 parts of pigment filler by dry weight. In other examples, the amount of polymeric binder ranges from about 7 parts to about 40 parts per 100 parts of the pigment filler by dry weight, or about 10 parts to about 40 parts per 100 parts of the pigment filler by dry weight, or about 15 parts to about 40 parts per 100 parts of the pigment filler by dry weight. In some examples, the amount of polymeric binder in the image-receiving layer ranges from about 5 parts to about 35 parts per 100 parts of the pigment filler by dry weight, or about 5 parts to about 30 parts per 100 parts of the pigment filler by dry weight, or about 5 parts to about 25 parts per 100 parts of the pigment filler by dry weight.

In another example, the image-receiving layer can be a "polymer-rich" composition. A "polymer-rich" composition, as described herein, refers to a composition where the weight percentage of the polymeric fraction in the composition is no less than 20% by weight. In another example, the polymeric fraction of the composition is no less than 40% by weight. A polymer rich composition can provide a printing media with excellent performance in the areas of ink durability and stain resistance.

Polymer-rich compositions can include a poly-alkene compound, such as a poly-alkene homopolymer, a poly-alkene copolymer, a modified poly-alkene, and combinations thereof. By definition, a "poly-alkene," as described herein, refers to a polymeric material formed via polymerization of an alkene monomer, i.e., $C_nH_{2n}$ and its derivatives, where n is within a range of about 7,000 to about 20,000. Some non-limiting examples of poly-alkenes that can be used include polyethylene homopolymer, polypropylene homopolymer, polytetrafluoroethylene (PTFE), polyamide, amide-modified polyethylene, amide-modified polypropylene, PTFE-modified polyethylene, PTFE-modified polypropylene, maleic anhydride-modified polyethylene, maleic anhydride-modified polypropylene, oxidized polyethylene, oxidized polypropylene, chloride polyethylene, chloride polypropylene, and combinations thereof.

The polymer-rich composition can also include any polymer that shows a strong capability to make a laminating composition on the supporting media substrate, or on the surface of the next layer. Some examples of such polymers include, but are not limited to, polyvinyl alcohol (examples of which include Kuraray Poval®235, Mowiol®40-88, and Mowiol®20-98 available from Kuraray America, Inc.), styrene-butadiene emulsion, acrylonitrile-butadiene latex, and any combinations thereof. In addition to the above binders, other aqueous binders can be added including: starch (including oxidized starch, cationized starch, esterified starch, enzymatically denatured starch and so on), gelatin, casein, soybean protein, cellulose derivatives including carboxymethyl cellulose, hydroxyethyl cellulose and the like; acrylic emulsion, vinyl acetate emulsion, vinylidene chloride emulsion, polyester emulsion, and polyvinylpyrrolidone. In another example, the polymer-rich composition can include a cross-linkable polymer such as polyurethane, acrylic-urethane hybrid polymers, and epoxy based polymers.

The image-receiving layer can also include a latex film-forming agent. The latex film-forming agent of the image-receiving layer is provided to facilitate forming a film of a latex ink (i.e., an image) that may be subsequently deposited on the print medium as an image. The "latex film-forming agent" may be any kind of chemical agent having water compatibility and temperature volatility that is capable of lowering an elastic modulus of ink latex particulates and of providing temporary plasticization to promote polymer chain motion to enhance forming a latex ink film from latex ink particulates. Representative examples of latex film-forming agents include, but are not limited to, citrate or sebacate compounds, ethyoxy alcohols, glycol oligomers and other low molecular weight polymers, glycol ether, glycerol acetals, surfactants that are either anionic, cationic, or non-ionic and have a backbone of more than 12 carbons, cyclic amide-like lactams, e.g., β-lactam, γ-lactam, and δ-lactam, a combination of two or more thereof, or a mixture of two or more thereof. In some examples, the latex ink film-forming agent is a cyclic amide-like lactam such as β-lactam, γ-lactam, and δ-lactam, or a mixture thereof. In an example, the latex ink film-forming agent is a γ-lactam. Representative examples of a γ-lactam include, but are not limited to, N-methyl-2-pyrrolidone, 5-methyl-2-pyrrolidone, and 2-pyrrolidone.

A ratio of an amount of a first pigment filler to an amount of the film forming agent may be (by weight) at a range of about 200:1 to about 10:1. In some examples, the ratio of the amounts of the first pigment filler to the film forming agent is at a range of about 150:1 to about 10:1, or about 100:1 to about 10:1, or about 80:1 to about 10:1, or about 65:1 to about 10:1, or about 50:1 to about 10:1, or about 35:1 to about 10:1. In some examples, the ratio of the amounts of the first pigment filler to the film forming agent is at a range of about 200:1 to about 15:1, or about 200:1 to about 20:1, or about 200:1 to about 25:1, or about 200:1 to about 30:1, or about 200:1 to about 35:1, or about 200:1 to about 40:1. In other examples, the ratio of the amounts of the first pigment filler to the film forming agent can be at a range of about 100:1 to about 11:1, or about 50:1 to about 12:1, or about 35:1 to about 13:1, or about 30:1 to about 14:1.

The first pigment filler can include any suitable pigment filler or combination of pigment fillers. For example, the first pigment filler can include either inorganic and/or organic particulates. The first pigment filler can be in solid powder form or it can be dispersed in a slurry. Some non-limiting examples of inorganic pigment fillers include aluminum silicate, kaolin clay, a calcium carbonate, silica, alumina, boehmite, mica, talc, or combinations or mixtures thereof. The inorganic pigment filler can include clay or a clay mixture. The inorganic pigment filler can include a calcium carbonate or a calcium carbonate mixture. The calcium carbonate can be one or more of ground calcium carbonate (GCC), precipitated calcium carbonate (PCC), modified GCC, or modified PCC. The inorganic pigment fillers can also include a mixture of a calcium carbonate and clay. In some examples, the inorganic pigment fillers can include two different calcium carbonate pigments (e.g., GCC and PCC).

Examples of organic pigment filler include, but are not limited to, particles, either existing in a dispersed slurry or in a solid powder, of polystyrene and its copolymers, polymethacrylates and their copolymers, polyacrylates and their copolymers, polyolefins and their copolymers, and combinations thereof. In one example, the pigment filler can include polyethylene, polypropylene, and combinations thereof. Additionally, the pigment fillers can include silica gel (e.g., Silojet®703C available from Grace Co.), modified (e.g., surface modified, chemically modified, etc.) calcium carbonate (e.g., Omyajet®B6606, C3301, and 5010, all of which are available from Omya, Inc.), precipitated calcium carbonate (e.g., Jetcoat®30 available from Specialty Minerals, Inc.), or combinations thereof.

In one example, the first pigment filler can be present at a dry amount ranging from about 5 wt % to about 90 wt % of the total wt % of the image-receiving layer, or from 40 wt % to about 85 wt % of the total wt % of the image-receiving layer, or from 60 wt % to 80 wt % of the image-receiving layer.

In each of these cases, the first pigment filler can have a particle size ranging from 0.1 μm to 20 μm. In some examples, the first pigment filler can have a particle size ranging from 0.2 μm to 18 μm. In some examples, the first pigment filler can have a particle size ranging from 0.5 μm to 15 μm.

In some examples, the image-receiving layer can include a polymer blend of a water-dispersible and a water-soluble polymer at a weight ratio from 2:1 to 10:1.

Any suitable water-dispersible polymer can be used. Non-limiting examples can include styrene-butadiene emulsion, acrylonitrile-butadiene latex, acrylic emulsion, vinyl acetate emulsion, vinylidene chloride emulsion, polyester emulsion, polyurethane dispersion, acrylic-urethane hybrid polymer dispersions, epoxy based dispersed polymers, the like, and combinations thereof.

The water-soluble polymer can also include any suitable water-soluble polymer. Non-limiting examples can include polyvinyl alcohol (examples of which include Kuraray Poval®235, Mowiol®40-88, and Mowiol®20-98 available from Kuraray America, Inc.), polyvinylpyrrolidone, starch (including oxidized starch, cationized starch, esterified starch, enzymatically denatured starch and so on), gelatin, casein, soybean protein, cellulose derivatives including carboxy-methyl cellulose, hydroxyethyl cellulose, the like, and combinations thereof.

While the image-receiving layer can provide an acceptable surface onto which the ink can be deposited to generate acceptable print quality, durability can still be an issue. Accordingly, after the image-receiving layer is applied to the print medium and the print medium is embossed, an abrasion-resistant layer can be applied to provide added durability to the embossed print medium. The abrasion-resistant coating can be applied at a coating weight of from 2 gsm to 20 gsm, or from 5 gsm to 15 gsm, or from 7 gsm to 15 gsm, or from 10 gsm to 15 gsm, or from 9 gsm to 20 gsm, or from 9 gsm to 15 gsm. In some examples a coating weight of at least 5 gsm can provide an abrasion-resistant layer having average to good durability, while maintaining good surface texture. As the coating weight increases, the durability of the abrasion-resistant layer generally increases. However, at coating weights above 20 gsm, the surface texture quality or embossing depths can begin to drop off. Thus, the coating weight of the abrasion-resistant layer can have an impact on retaining the embossing depth.

In some examples, the abrasion-resistant layer can have an appropriate composition and coating weight to retain the embossing depth of the image-receiving layer even after the abrasion-resistant layer is applied. In some examples the abrasion-resistant layer can retain an embossed depth within 50%, within 20%, or even within 10% of the embossing depth of the image-receiving layer. The term "retain" with respect to the embossed depth is to be understood so that the abrasion-resistant layer retains the same embossing depth, within the specified tolerance level, as the embossed image-receiving layer prior to application of the abrasion-resistant layer. For example, where the abrasion-resistant layer retains an embossed depth within 50% of the embossing depth, and the image-receiving layer was embossed at an embossing depth of 10 μm, the abrasion-resistant layer retains an embossed depth of 10 μm minus 50% (i.e. an embossed depth of at least 5 μm). In another example, where the image-receiving layer was embossed at an embossing depth of 100 μm and the abrasion-resistant layer retains an embossed depth within 20% of the embossing depth, the abrasion-resistant layer retains an embossed depth of 100 μm minus 20% (i.e. an embossed depth of at least 80 μm).

In some examples, the cross-linked polymer network includes a polyurethane polymer. In one example, the polyurethane can be cross-linked with a cross-linking agent. In one example, the polyurethane can be a self-cross-linking polyurethane. A self-cross-linking polyurethane can be formed by reacting an isocyanate with a polyol, where both isocyanates and polyols have, on average, less than three end functional groups per molecule so that the polymeric network is based on a liner polymeric chain structure. In one example, the polyurethane chain can have a trimethyloxysiloxane group and the cross-linking action can take place via hydrolysis of the function group to form a silsesquioxane structure. The polyurethane chain can also have an acrylic functional group, and the cross-linked structure can be formed by nucleophilic addition to an acrylate group through acetoacetoxy functionality.

In some other examples, the polyurethane can be a vinyl-urethane hybrid polymer or an acrylic-urethane hybrid polymer. In yet some other examples, the polyurethane can be an aliphatic polyurethane-acrylic hybrid polymer.

In some examples, the polyurethane can include a modified or unmodified polymeric core of either polyurethane or a copolymer that includes polyurethane. Suitable polyurethanes can include aliphatic as well as aromatic polyurethanes. In a more specific example, the polyurethane can be a reaction product of the following components: a polyisocyanate having at least two isocyanate (—NCO) functionalities per molecule with, at least, one isocyanate-reactive group such as a polyol having at least two hydroxy groups or an amine. Suitable polyisocyanates include diisocyanate monomers, and oligomers.

In another example, the polyurethane can include an aromatic polyether polyurethane, an aliphatic polyether polyurethane, an aromatic polyester polyurethane, an aliphatic polyester polyurethane, an aromatic polycaprolactam polyurethane, an aliphatic polycaprolactam polyurethane, or a combination thereof. In a more specific example, the polyurethane can include an aromatic polyether polyurethane, an aliphatic polyether polyurethane, an aromatic polyester polyurethane, an aliphatic polyester polyurethane, and a combination thereof.

Some non-limiting, representative commercially-available examples of suitable polyurethanes can include NeoPac®R-9000, R-9699, and R-9030 (from Zeneca Resins), Printrite®DP376 and Sancure®AU4010 (from Lubrizol), and Hybridur®570 (from Air Products). Other examples can include Sancure®2710 and/or Avalure®UR445 (which are equivalent copolymers of polypropylene glycol, isophorone diisocyanate, and 2,2-dimethylolpropionic acid, having the International Nomenclature Cosmetic Ingredient name "PPG-17/PPG-34/IPDI/DMPA Copolymer"), Sancure®878, Sancure®815, Sancure®1301, Sancure®2715, Sancure®2026, Sancure®1818, Sancure®853, Sancure®830, Sancure®825, Sancure®776, Sancure®850, Sancure®12140, Sancure®12619, Sancure®835, Sancure®843, Sancure®898, Sancure®899, Sancure®1511, Sancure®1514, Sancure®1517®, Sancure®1591, Sancure®2255, Sancure®2260, Sancure®2310, Sancure®2725, and Sancure®12471 (all commercially available from Lubrizol Inc.).

In some examples, the cross-linked polymer network can include an epoxy. The epoxy can include alkyl and aromatic epoxy resins or epoxy-functional resins, such as for example, epoxy novolac resin(s) and other epoxy resin derivatives. Epoxy-functional resins can include at least one, or two, or more pendant epoxy moieties. The molecules can be aliphatic, aromatic, linear, branched, cyclic, or acyclic. If cyclic structures are present, they may be linked to other cyclic structures by single bonds, linking moieties, bridge structures, pyro moieties, and the like. Some non-limiting examples of suitable epoxy functional resins are commercially available and include, without limitation, AncaRez®AR555 (commercially available from Air Products), AncaRez®AR550, Epi-Rez®3510W60, Epi-Rez®3515W6, or Epi-Rez®3522W60 (commercially available from Hexion).

In some examples, the epoxy can include an aqueous dispersion of an epoxy resin. Some non-limiting examples of commercially available aqueous dispersions of epoxy resins include Araldite®PZ3901, Araldite®PZ3921, Araldite®PZ3961-1, Araldite®PZ323 (commercially available from Huntsman), Waterpoxy®1422 (commercially available from Cognis) or AncaRez®AR555 1422 (commercially available from Air Products).

In some examples, the epoxy can be self-cross-linked. In some examples, the epoxy can be cross-linked via epoxy resin hardeners. Some non-limiting examples of epoxy resin hardeners include liquid aliphatic or cycloaliphatic amine hardeners of various molecular weights, in 100% solids or in emulsion or water and solvent solution forms. Amine adducts with alcohols and phenols or emulsifiers can also be envisioned. Examples of suitable commercially available hardeners include Anquawhite®100 (from Air Products), Aradur®3985 (from Huntsman), and EPI-CURE® 8290-Y-60 (from Hexion). The second polymeric network can include a water-based polyamine as an epoxy resin hardener. Such epoxy resin hardeners can be, for examples, water-based polyfunctional amines, acids, acid anhydrides, phenols, alcohols and/or thiols.

In some other examples, the epoxy can include a polyglycidyl or a polyoxirane resin. These epoxies can also be self-cross-linked (through catalytic homopolymerisation of oxirane function group) or they can be cross-linked with the help of a wide range of co-reactants including polyfunctional amines, acids, acid anhydrides, phenols, alcohols, and thiols.

In a more specific example, the cross-linked polymer network can include a water-based epoxy resin and water-based polyamine as an epoxy resin hardener. In another more specific example, the cross-linked polymer network can include a polyurethane and a polyglycidyl or polyoxirane resin. In yet another more specific example, the cross-linked polymer network can include a vinyl-urethane hybrid polymer or acrylic-urethane hybrid polymer and a water-based epoxy resin, including a water-based polyamine as an epoxy resin hardener.

The cross-linked polymer network can be present in the abrasion-resistant layer in an amount from about 10 wt % to about 80 wt %. In another example, the cross-linked polymer network can be present in an amount from about 10 wt % to about 70 wt %. In another example, the cross-linked polymer network can be present in an amount from about 15 wt % to about 60 wt %.

Where both a polyurethane and an epoxy are present in the abrasion-resistant layer, they can be present in a weight ratio of from 1:3 to 3:1, or from 1:2 to 2:1, or from 1:2 to 1:1, or from 1:1 to 1:2.

The abrasion-resistant layer can also include a second pigment filler. Any pigment filler that can be used for the first pigment filler can also be used for the second pigment filler. However, while the first pigment filler is typically present in the image-receiving layer in amounts in excess of 40 wt %, the second pigment filler is typically present in the abrasion-resistant layer in an amount less than 40 wt %, such as from 0.5 wt % to 40 wt %, or from 1 wt % to 40 wt %, or from 5 wt % to 30 wt %.

In further detail regarding the abrasion-resistant layer, as mentioned, this layer can also include a wax. The wax can typically be a synthetic or petroleum wax. However, other waxes can be used, such as vegetable waxes, animal waxes, mineral waxes, and the like. In one specific example, the wax can be a paraffin wax, a microcrystalline wax, a polyethylene wax, the like, or a combination thereof. In another specific example, the wax can be a high-melt wax, such as a high-melt polyethylene wax. A high-melt wax can be a wax that begins to soften at temperatures of at least 130° C. Some examples of commercially available waxes can include Slip-Ayd®SL100, Slip-Ayd®SL177, Slip-Ayd®SL18, Slip-Ayd®SL404, Slip-Ayd®SL417, Slip-Ayd®SL425, Slip-Ayd®SL4709, Slip-Ayd®SL506, Slip-Ayd®SL508, Slip-Ayd®SL50, Slip-Ayd®SL523, Slip-Ayd®SL530, Slip-Ayd®SL551, Slip-Ayd®SL555, Slip-Ayd®SL600, Slip-Ayd®SL620, Slip-Ayd®SL700, Slip-Ayd®SL78, and Slip-Ayd®SL94 (available from Elementis Specialties), and Acculin™400, Acculin™500, Acculin™600, Acculin™655, Acculin™725, Acculin™850, Acculin™1000, and Acculin™2000 (available from The International Group).

The wax can be present in the abrasion-resistant layer in an amount from about 1 wt % to 20 wt % in one example. In another example, the wax can be present in an amount from about 3 wt % to 20 wt %, or about 5 wt % to about 15 wt %. In another example, the wax can be present in an amount from about 7 wt % to about 15 wt %.

In some other examples, the abrasion-resistant layer can also contain a polymeric binder to provide good adhesion between the abrasion-resistant layer and image-receiving layer, if desired. The polymeric binder can be any suitable binder, including non-ionic polymers, cationic charged polymers, or any other suitable binder or mixtures thereof. Examples of suitable polymeric binders include polyvinyl alcohol (examples of which include Kuraray Poval®235, Mowiol®40-88, and Mowiol®20-98 available from Kuraray America, Inc.), styrene-butadiene emulsion, acrylonitrile-butadiene latex, or any combinations. Moreover, in addition to the above binders, other aqueous binders can be added including: starch (including oxidized starch, cationized starch, esterified starch, enzymatically denatured starch and so on), gelatin, casein, soybean protein, cellulose derivatives including carboxy-methyl cellulose, hydroxyethyl cellulose and the like; acrylic emulsion, vinyl acetate emulsion, vinylidene chloride emulsion, polyester emulsion, and polyvinylpyrrolidone. However, the polymeric binder will typically include a water-dispersible polymer rather than a water-soluble polymer. The amount of the polymeric binder can represent from about 5 to about 40 parts per 100 parts of the second pigment filler by dry weight; or can represent from about 10 to about 30 parts per 100 parts of the second pigment filler by dry weight.

The abrasion-resistant layer can further include a film-forming agent. It is to be understood that the "film-forming agent" may be capable of lowering the elastic modulus of polymer particulates (specifically found in latex inks to be printed on the printable medium) and providing temporary plasticization, which promotes polymer chain motion of the polymer particulates during the film forming process. Thus, the "film-forming agent" does not form a film per se, but rather, assists in the polymers present in forming a desirable film. Thus, the polymer particulates that are present are more readily able to coalesce, and therefore the film-forming agent can improve the film-forming properties of polymer particulates. In some examples, the film forming agent can include citrate compounds, sebacate compounds, ethoxy alcohols, glycol oligomers, glycol polymers, glycol ether, glycerol acetals, anionic, cationic or non-ionic surfactants having a backbone of 12 carbons or more (e.g., propylene glycol monoester of C-18 fatty acids and propylene glycol mono oleate (each of which is commercially available under the trade name Loxanol® by BASF Corp), cyclic amides, and combinations thereof. The cyclic amides may be β-lactams (e.g., clavam, oxacephem, cephem, penam, carbapenam, and monobactam), γ-lactams, δ-lactams (e.g., caprolactam and glucarolactam), and combinations thereof. In one specific example, the film-forming agent can be a γ-lactam. Representative examples of a γ-lactam include N-methyl-2-pyrrolidone, 5-methyl-2-pyrrolidone, and 2-pyrrolidone. In one specific example, the film-forming agent can be a surfactant. In a further example, the surfactant can be a non-ionic surfactant or combination of non-ionic surfactants.

The film-forming agent can be present in the abrasion-resistant layer in an amount from about 1 wt % to about 15 wt %. In another example, the film-forming agent is present in an amount from about 2 wt % to about 10 wt %. In another example, the film-forming agent is present in an amount from about 3 wt % to about 8 wt %.

In one specific example, the abrasion-resistant layer can include from about 5 wt % to about 40 wt % of a polyurethane, from about 5 wt % to about 30 wt % of an epoxy, from about 5 wt % to about 30 wt % of an epoxy resin hardener or curing agent, from about 3 wt % to about 20 wt % of a wax, from about 10 wt % to about 40 wt % of a second pigment filler, and from about 2 wt % to about 15 wt % of a film-forming agent. In a more specific example, the abrasion-resistant layer can include 11 parts of Printrite®DP376 (commercially available from Lubrizol), 8 parts Araldite®PZ3901 (commercially available from Huntsman), 8 parts Aradur®3985 (commercially available from Huntsman), 5 parts Slip Ayd®SL177 (commercially available from Elementis Specialties), 0.8 parts SD690 (commercially available from Beijing Aerospace Sai De Power Material Technical Company), 10 parts Hydrocarb®H60 (commercially available from Omya), 1 part Tergitol®15S-7 (commercially available from Dow Chemical), and 1.6 parts Tegowet®510 (commercially available from Evonik).

Application of the abrasion-resistant layer to the embossed image-receiving layer can from a durable embossed print media. Accordingly, a printed feature can be applied on top of the embossed print medium to form a printed article that includes a durable textured surface. The printed article can result from any suitable printing process for embossed surfaces. One non-limiting example can include an inkjet printing process, such as a latex inkjet printing process. Any suitable colorant, ink, or dye can be used to prepare the printed article. Any suitable printed layer or design can also be applied to the embossed print media to prepare a printed article.

Turning now to the figures, FIG. 1 shows an example of an embossed print medium 100. The media substrate 110 has been coated with an image-receiving layer 120. As can be seen from FIG. 1, the image-receiving layer has been embossed to provide the embossed print medium with a textured surface. However, the embossed print medium 100 does not include an abrasion-resistant layer. Absence of the abrasion-resistant layer can result in a lack of durability of the textured surface.

Figure 2:
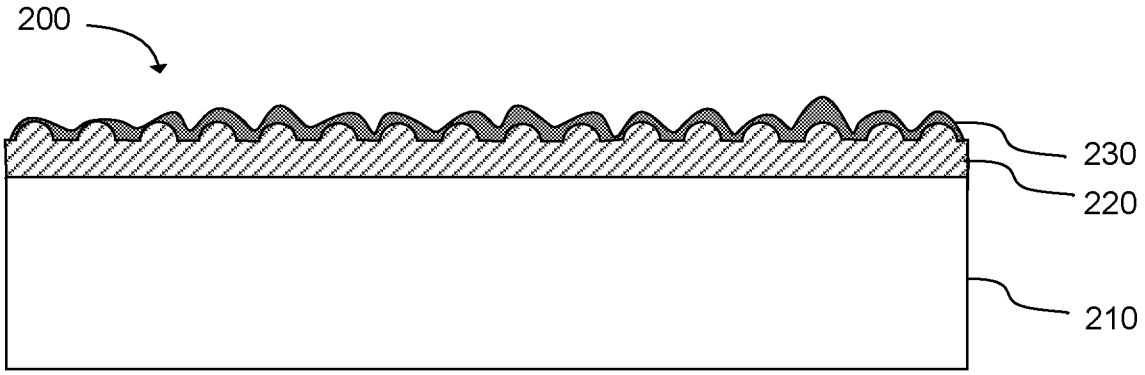
FIG. 2 is a cross-sectional view of an embossed print medium as shown in FIG. 1, but which also includes an abrasion-resistant layer applied after the print medium is embossed in accordance with examples of the present disclosure.

In contrast, FIG. 2 shows an example of an embossed print medium 200 that includes a media substrate 210, an embossed image-receiving layer 220, and an abrasion-resistant layer 230. The abrasion-resistant layer 230 can improve the durability of the textured surface. Where the coating weight is in an appropriate range, the abrasion-resistant layer can improve durability of the textured surface without negatively impacting the embossing depth of the textured surface.

Figure 3:
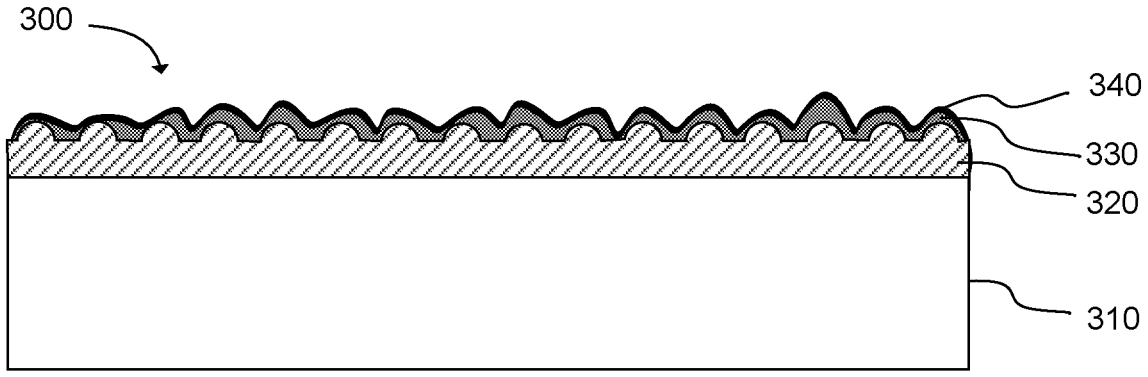
FIG. 3 is a cross-sectional view of an embossed print medium as shown in FIG. 2, but which includes a printed feature that is applied to the embossed print medium.

FIG. 3 shows an example of an embossed print medium 300 that includes a media substrate 310, an embossed image-receiving layer 320, and an abrasion-resistant layer 330. A printed feature 340 has been applied to the embossed print medium.

Figure 4:
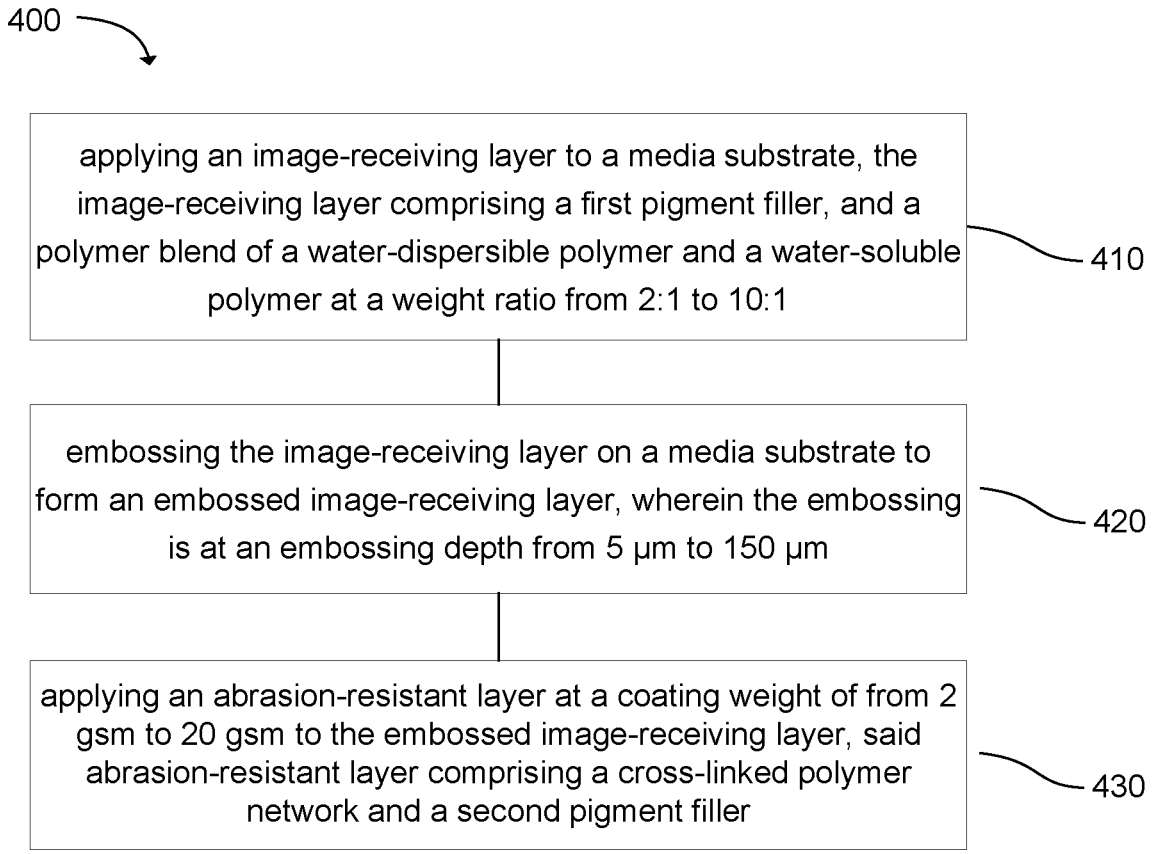
FIG. 4 illustrates a method of preparing an embossed print medium in accordance with examples of the present disclosure.

FIG. 4 depicts a method 400 of preparing an embossed print medium. The method includes various steps, which may or may not follow any particular order. One step can include applying 410 an image-receiving layer to a media substrate, the image-receiving layer including a first pigment filler, and a polymer blend of a water-dispersible polymer and a water-soluble polymer at a weight ratio from 2:1 to 10:1. Another step can include embossing 420 the image-receiving layer on a media substrate to form an embossed image-receiving layer, wherein the embossing is at a depth from 5 μm to 150 μm. Another step can include applying 430 an abrasion-resistant layer at a coating weight of from 2 gsm to 20 gsm to the embossed image-receiving layer, wherein the abrasion-resistant layer includes a cross-linked polymer network and a second pigment filler. In certain specific examples, the method can include a step of laminating the embossed print medium, e.g., such as on a bottom side of the media substrate which is opposite of a printing surface that is embossed and coated with the abrasion-resistant layer.

It is noted that, as used in this specification and the appended claims, the singular forms "a," "an," and "the" include plural referents unless the content clearly dictates otherwise.

"Substrate" or "media substrate" includes any base material that can be coated in accordance with examples of the present disclosure, such as film base substrates, polymer substrates, conventional paper substrates, photobase substrates, offset media substrates, and the like. Further, pre-coated and film coated substrates can be considered a "substrate" that can be likewise be coated in accordance with examples of the present disclosure.

As used herein, the term "about" is used to provide flexibility to a numerical range endpoint by providing that a given value may be "a little above" or "a little below" the endpoint. The degree of flexibility of this term can be dictated by the particular variable and can be determined based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight ratio range of about 1 wt % to about 20 wt % should be interpreted to include not only the explicitly recited limits of 1 wt % and about 20 wt %, but also to include individual weights such as 2 wt %, 11 wt %, 14 wt %, and sub-ranges such as 10 wt % to 20 wt %, 5 wt % to 15 wt %, etc.

As a further note, in the present disclosure, it is noted that when discussing the embossed print medium, and the method of preparing the embossed print medium, or the printed article, each of these discussions can be considered applicable to each of these examples, whether or not they are explicitly discussed in the context of that example. Thus, for example, in discussing details about the embossed print medium per se, such discussion also refers to the method and printed article, and vice versa.

The following illustrate examples of the disclosure. However, it is to be understood that these examples are merely exemplary or illustrative of the application of the principles of the present disclosure. Numerous modifications and alternative compositions, methods, and systems may be devised by those skilled in the art without departing from the spirit and scope of the present disclosure. The appended claims are intended to cover such modifications and arrangements.

EXAMPLE

Various experiments were conducted to determine abrasion and scratch resistance of various embossed print media. Generally, embossing patterns and preparation methods can be related to media durability. In general, a deeper and rougher embossing surface can decrease the durability of the media surface when performing a durability test using a brush scratching test under normal force. In the present examples, the media substrate had basis weight of 290 gsm. The image-receiving layer included 80 wt % Hydrocarb® H60, 15 wt % Joncryl® 2640, and 5 wt % Moviol® 6-98, and was applied at a coating weight of 20 gsm. The abrasion-resistant layer included 25 wt % PrintRite® DP 376, 20 wt % Araldite® PZ 3901, 20 wt % Aradur® 3985, 10 wt % SLIP-AYD® SL 177, and 25 wt % of Hydrocarb H60. Embossing was carried out at an average depth of 70 μm.

In the current example, a scratch test was performed on the various types of embossed coated media. These tests were carried out according to ASTM 793 to determine the durability of various coating approaches and coating weights of an abrasion-resistant coating applied to the various embossed print media. Further, the impact of the abrasion-resistant coating on embossing depth was also evaluated. For each test, a rank ranking was assigned ranging from 1-Poor to 5-Excellent. The media examined and scored is found in Table 1 below:

TABLE 1

| Test ID | Coat weight of abrasion-resistant layer, gsm | Rz Measurement, μm (ISO 4287) | Score after 300 brushing scratch test | ASTM 793 Type II test | Embossing pattern significance before scratching test |
|---|---|---|---|---|---|
| [1]Exp. 1 | 10 | 50 | 1 | Fail | 5 |
| [2]Exp. 2 | 7 | 78.3 | 3 | Boarder line | 5 |
| [2]Exp. 3 | 9 | 75.2 | 5 | Pass | 5 |
| [2]Exp. 4 | 10 | 70.7 | 5 | Pass | 5 |
| [2]Exp. 5 | 12 | 62.9 | 5 | Pass | 4 |
| [2]Exp. 6 | 25 | not measured | 5 | Pass | 3 |
| [3]Exp. 7 | NA | 80.7 | 1 | Fail | 5 |

[1]Embossing after abrasion-resistant layer applied
[2]Embossing after application of image-receiving layer, but prior to application of abrasion-resistant layer
[3]Embossing after application of image-receiving layer, but no abrasion-resistant layer applied.

As can be seen in Table 1 below, the coating structure where embossing is performed after the abrasion-resistant layer is applied (Exp. 1) resulted in a failed scratch test, even though the embossing depth was on moderate. For coating structures where the abrasion-resistant layer was applied after embossing, an improvement in durability was noted. This was especially true for coating weights of 9 gsm and above. Further, where no abrasion-resistant layer was applied, the coating structure also failed the scratch test.

It is worth noting that where the coating of the abrasion-resistant layer exceeds 20 gsm, the embossing pattern or embossing depth can begin to become more significantly diminished. Therefore, the range of 2 μm to 20 μm provides a good workable range for the abrasion-resistant layer. If the coating weight of the abrasion-resistant layer is too thick, it can decrease the embossed-pattern significance. However, where the coating weight of the abrasion-resistant layer is too thin, it can provide insufficient durability to the embossed print medium. Thus, in one example, a range from 9 μm to 15 μm, in some examples, may provide a good balance of abrasion resistance, as shown in Table 1, and retaining the embossing feature at a desirable level compared to thicker coatings.

What is claimed is:

1. An embossed print medium, comprising:

a media substrate;

an embossed image-receiving layer formed on the media substrate, said embossed image-receiving layer comprising a first pigment filler, and a polymer blend of a water-dispersible polymer and a water-soluble polymer at a weight ratio from 2:1 to 10:1, wherein the image-receiving layer is embossed at an embossing depth from 5 μm to 150 μm; and an abrasion-resistant layer applied to the embossed image-receiving layer at a coating weight of from 2 gsm to 20 gsm, wherein the abrasion-resistant layer comprises from 10 wt % to 80 wt % of a cross-linked polymer network, from 5 wt % to 40 wt % of a second pigment filler having an average particle size from 0.1 μm to 5 μm, and from 3 wt % to 20 wt % of a Polyethylene wax.

2. The embossed print medium of claim 1, wherein the abrasion-resistant layer is applied at a coating weight of from 9 gsm to 15 gsm.

3. The embossed print medium of claim 1, wherein the abrasion-resistant layer retains an embossed depth within 50% of the embossing depth.

4. The embossed print medium of claim 1, wherein the abrasion-resistant layer retains an embossed depth within 20% of the embossing depth.

5. The embossed print medium of claim 1, wherein the cross-linked polymer network comprises a polyurethane, an epoxy, or combination thereof.

6. The embossed print medium of claim 5, wherein the polyurethane is present and comprises an aromatic polyether polyurethane, an aliphatic polyether polyurethane, an aromatic polyester polyurethane, an aliphatic polyester polyurethane, an aromatic polycaprolactam polyurethane, an aliphatic polycaprolactam polyurethane, a vinyl-urethane hybrid polymer, an acrylic-urethane hybrid polymer, or combination thereof.

7. The embossed print medium of claim 5, wherein the epoxy is present and comprises a polyglycidyl, a polyoxirane, an alkyl epoxy, an aromatic epoxy, a novolac epoxy, an epoxy derivative, or combination thereof.

8. The embossed print medium of claim 5, wherein the cross-linked polymer network comprises the polyurethane and the epoxy at a weight ratio from 2:1 to 1:2.

9. A method of preparing the embossed print medium of claim 1, comprising:

applying an image-receiving layer to a media substrate;

embossing the image-receiving layer on a media substrate to form the embossed image-receiving layer; and applying the abrasion-resistant layer to the embossed image-receiving layer.

10. The method of claim 9, wherein the abrasion-resistant layer is applied at a coating weight of from 9 gsm to 15 gsm.

11. The method of claim 9, wherein the abrasion-resistant layer retains an embossed depth within 50% of the embossing depth.

12. The method of claim 9, further comprising laminating a bottom side of the media substrate.

13. A printed article, comprising:

the embossed print medium of claim 1; and a printed feature applied to the embossed print medium.

14. The printed article of claim 13, wherein the cross-linked polymer network comprises a polyurethane, an epoxy, or combination thereof.

15. The printed article of claim 14, wherein the cross-linked polymer network comprises the polyurethane and the epoxy at a weight ratio from 2:1 to 1:2.

16. The method of claim 9, wherein the abrasion-resistant layer retains an embossed depth within 20% of the embossing depth.

17. The method of claim 9, wherein the cross-linked polymer network comprises a polyurethane, an epoxy, or combination thereof.

18. The method of claim 17, wherein the polyurethane is present and comprises an aromatic polyether polyurethane, an aliphatic polyether polyurethane, an aromatic polyester polyurethane, an aliphatic polyester polyurethane, an aromatic polycaprolactam polyurethane, an aliphatic polycaprolactam polyurethane, a vinyl-urethane hybrid polymer, an acrylic-urethane hybrid polymer, or combination thereof.

19. The method of claim 17, wherein the epoxy is present and comprises a polyglycidyl, a polyoxirane, an alkyl epoxy, an aromatic epoxy, a novolac epoxy, an epoxy derivative, or combination thereof.

20. The method of claim 17, wherein the cross-linked polymer network comprises the polyurethane and the epoxy at a weight ratio from 2:1 to 1:2.

* * * * *